United States Patent [19]

Honjo et al.

[11] Patent Number: 4,598,034

[45] Date of Patent: Jul. 1, 1986

[54] FERRITE CARRIERS FOR ELECTROPHOTOGRAPHIC DEVELOPMENT

[75] Inventors: Toshio Honjo, Abiko; Yukio Seki, Kashiwa, both of Japan

[73] Assignee: Nippon Iron Powder Co., Ltd., Kashiwa, Japan

[21] Appl. No.: 689,400

[22] Filed: Jan. 7, 1985

Related U.S. Application Data

[63] Continuation-in-part of Ser. No. 525,562, Jan. 25, 1984, abandoned.

[30] Foreign Application Priority Data

Sep. 13, 1982 [JP] Japan ..... 57-158207

[51] Int. Cl.[4] ..... G03G 9/10; G03G 9/00

[52] U.S. Cl. ..... 430/106.6; 430/108; 252/62.6; 252/62.61; 252/62.62; 252/62.64

[58] Field of Search ..... 430/106.6, 108; 252/62.64, 62.6, 62.61, 62.62

[56] References Cited

U.S. PATENT DOCUMENTS

| | | | |
|---|---|---|---|
| 3,607,753 | 9/1971 | Suchoff | 252/62.61 |
| 3,914,181 | 10/1975 | Berg et al. | 430/108 X |
| 4,125,667 | 11/1978 | Jones | 430/108 X |
| 4,282,302 | 8/1981 | Makino et al. | 252/62.64 X |
| 4,485,162 | 11/1984 | Imamura et al. | 430/106.6 |

FOREIGN PATENT DOCUMENTS

| | | | |
|---|---|---|---|
| 628315 | 10/1961 | Canada | 252/62.64 |
| 823557 | 11/1959 | United Kingdom | 252/62.64 |

*Primary Examiner*—Roland E. Martin

*Attorney, Agent, or Firm*—Jeffers, Irish & Hoffman

[57] ABSTRACT

A carriers for electrophotographic development which comprises essentially a disintegrated powder of granules consisting essentially of the compound represented by the formula $$(MO)_X(Fe_2O_3)_Y$$

in which M is at least one metal selected from the group consisting of Li, Zn, Cd, Cu, Co, and Mg, and X (mol)/Y (mol)≦0.85.

12 Claims, 4 Drawing Figures

FERRITE CARRIERS FOR ELECTROPHOTOGRAPHIC DEVELOPMENT

BACKGROUND OF THE INVENTION

1. Field of the Invention

This invention relates to carriers for electrophotographic development.

2. Description Of The Prior Art

A number of carriers for electrophotographic development are known including reduced iron powders, atomized iron powders, iron powders obtained by pulverizing iron wastes such as from cutting, and the like. However, this type of carrier is so low in resistance that bias voltage is apt to leak, and black lines are formed on copies obtained by electrophotography, thus making it difficult to read characters or letters in portions where the black lines are superposed thereon.

Another type of carrier is known in which iron powder is oxidized or coated with resins thereby producing a carrier of high electric resistance. However, this type of carrier deteriorates as used over a long time, so that a so-called "excessively edged" image is reproduced by electrophotography in which a solid portion comes off at the center thereof, accompanied by occurrence of fogging. Moreover, in the former case, there is a limitation on the level of resistance imparted to the iron powder. Where a duplicating machine receives defects scratches on the photosensitive drum thereof, bias voltage will leak. This is true of the latter case where the resin coating is thin. Although there is experienced little leakage of bias voltage when the resin coating is thick in the latter case, such a carrier becomes so high in resistance that the resulting images are excessively fringed or edged. With resin-coated carriers, the charging characteristics are determined depending on the type of resin being coated and thus they are used only in combination with specific types of toners.

Although ferrite ($MO.Fe_2O_3$) carriers are also known, this type of carrier has such a high resistance that an excessive edging effect is unfavorably produced on images.

Some known carriers described above which have residual magnetism are disadvantageous in that carrier particles attract one another, thus preventing the smooth flow of a developing agent. In apparatus in which the flow of developing agent gives a great influence on a toner concentration control device, the degree of residual magnetism will produce a serious problem.

SUMMARY OF THE INVENTION

It is an object of the present invention to provide a carrier for electrophotographic development which permits little leakage of bias voltage and does not cause to form solid lines on electrophotographic images.

It is another object of the invention to provide a carrier for electrophotographic development which does scarcely deteriorate in long use and does not cause formation of excessively edged images.

It is a further object of the invention to provide a carrier for electrophotographic development which does not permit leakage of bias voltage even when a photosensitive drum of a duplicating machine suffers defects on the surface thereof.

It is still a further object of the invention to provide a carrier for electrophotographic development which is usable in a wide variety of combinations with toners.

It is still a further object of the invention to provide a carrier for electrophotographic development which has little or no residual magnetism, so that carrier particles do no attract one another.

The above objects can be achieved, according to the present invention, by a carrier for electrophotographic development which comprises essentially a disintegrated powder of granules consisting essentially of the compound represented by the formula $$(MO)_X(Fe_2O_3)_Y$$

in which M represents at least one metal selected from the group consisting of Li, Zn, Cd, Cu, Co, and Mg, and $X(mol)/Y(mol) \leqq 0.85$.

DETAILED DESCRIPTION OF THE INVENTION

Figure 1:
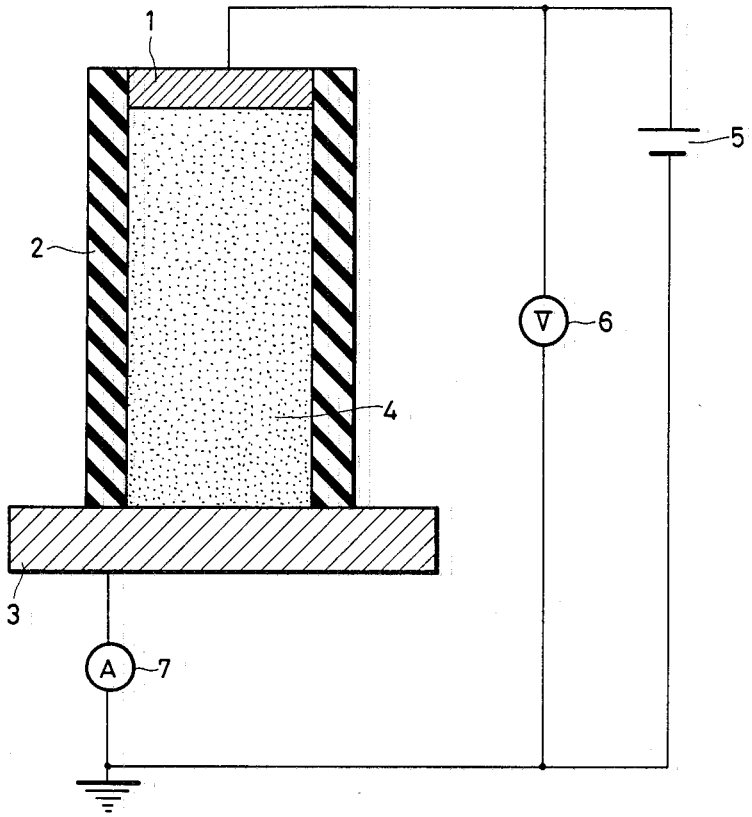
FIG. 1 is a schematic view of a resistance-measuring device of carrier.

Iron powder carriers which are oxidized or are coated with resins undergo changes in chemical composition on their surface owing to the change in the oxide film or owing to the separation of the resin coating. This results in a variation in the carrier resistance, thus leading to deterioration of the carrier (except for a spent phenomenon where a toner powder is attached mechanically to the surface of carrier). From the above, it will be noted that conductivity of carrier is influenced by a change in composition of the carrier surface. In order to present the change of the composition in the carrier surface, it is necessary to make a uniform composition of carrier and to properly select a material which undergoes less chemical changes. Taking a quality of image into account, the carrier for electrophotography should have a suitable level of resistance.

We have now found that a disintegrated powder of granules having a composition of $(MO)_X(Fe_2O_3)_Y$ in which the ratio of X/Y by mole is in the range not more than 0.85, inclusive, satisfies the above requirement and produces good results. In the above formula, M is Li, Zn, Cd, Cu, Co, or Mg, which is used singly or in combination. As indicated above, the ratio by mole of X/Y is in the range of not more than 0.85, inclusive. Preferably, the ratio is such that $0.42 \leqq X/Y \leqq 0.85$. If the ratio is less than 0.42, the saturation magnetization of the carrier becomes unfavorably as low as below 40 emu/g. The mixing ratio should be suitably changed within the above-defined range in order to obtain intended magnetic characteristics.

Preferable examples of the compounds represented by the formula $(MO)_X(Fe_2O_3)_Y$ include copper-zinc ferrite represented by the formula: $(CuO)_a(ZnO)_b(Fe_2O_3)_c$ in which $a(mol)+b(mol)+c(mol)=1$, $0.05 \leqq a \leqq 0.45$, $0 \leqq b \leqq 0.40$, and $(a+b)/c \leqq 0.85$, and magnesium-zinc ferrite represented by the formula:

$(MgO)_d(ZnO)_e(Fe_2O_3)_f$ in which $d(mol)+e(mol)+f(mol)=1$, $0.13 \leqq d \leqq 0.22$, $0.17 \leqq e \leqq 0.25$, and $(d+e)/f \leqq 0.85$.

In case that molar amount a of the copper-zinc ferrite $(CuO)_a(ZnO)_b(Fe_2O_3)_c$ is less than 0.05, or that molar amount b is more than 0.40, the saturation magnetization of the carrier becomes unfavorably as low as below 10 emu/g. In case that a exceeds 0.45 and (a+b)/c exceeds 0.85, the resistance of the carrier becomes unfavorably high and, as a result of copying, an image having conspicuous edges and solid portions left out at the center thereof is obtained.

In case that molar amount d of the magnesium-zinc ferrite $(MgO)_d(ZnO)_e(Fe_2O_3)_f$ is less than 0.13, or that molar amounts e is less than 0.17, the saturation magnetization of the carrier becomes unfavorably as low as below 35 emu/g. In case that d, e and (d+e)/f exceed the upper limitations thereof, i.e. 0.22, 0.25 and 0.85, respectively, the resistance of the carrier becomes unfavorably high and, as a result of copying, an image having conspicuous edges and solid portions left out at the center thereof is obtained.

Preparation of the carrier is described briefly. $Fe_2O_3$ and MO or salts capable of yielding MO are mixed in such a way that the molar ratio of X/Y in the composition of $(MO)_X(Fe_2O_3)_Y$ is in the range not more than 0.85. The mixture is powdered and mixed together in a wet ball mill or wet vibration mill for 1 hour or more. The resulting slurry is dried and powdered, followed by calcining at a temperature of 700° to 1000° C. After the calcination, the powder is further finely powdered in a wet ball mill, wet vibration mill or the like to a level of below 10 microns, preferably below 5 microns and granulated, followed by sintering at a temperature of 1050° C. to 1500° C. for a period of 2 to 24 hours. The resulting sintered material is disintegrated and classified. If necessary, the classified powder may be slightly reduced or may be further re-oxidized on the surface thereof at low temperatures. The powder may be optionally coated with a resin. The type of resin coated should be determined depending on the type of toner used in combination. By the above procedure an ideal carrier can be obtained but the present invention is not limited to carriers which are obtained by the procedure described above.

The carrier obtained according to the invention does not involve leakage of bias voltage and deteriorates only in a slight degree, and is capable of yielding images free of excessive edging.

The carrier of the invention which is not subjected to the oxidation or resin coated treatment has substantially the same charging amount as known oxidized iron powders, and may be generally used in any combination with toners. As a matter of course, the carrier may be appropriately reduced or oxidized in order to change its resistance. The carrier is a disintegrated powder of granules and is thus porous. When a resin is coated onto the powder, part of the resin impregnates in the inside of the powder through pores and a tenacious resin film is formed on the carrier surface. Accordingly, removal of the resin film by mechanical impact hardly takes place.

The carrier obtained from granules has another advantage that it has a small apparent density (e.g. below 3.5 g/cm$^3$), so that a load exerted on a motor used to rotate the magnetic brush is small, and it is sufficient to place a small amount of carrier in a development box.

The present invention is described more particularly by way of examples.

EXAMPLE 1

15 mol% of CuO, 32 mol% of ZnO, and 53 mol% of $Fe_2O_3$ were powdered and mixed in a wet ball mill for 10 hours and after drying, the mixture was kept at 950° C. for 4 hours. The mixture was then powdered in a wet ball mill for 24 hours to a level of below 5 microns. The resulting slurry was granulated and dried, which was kept at 1140° C. for 6 hours, followed by disintegrating into pieces and classifying to obtain a powder having a size of from 150 to 250 mesh.

The powdery carrier was subjected to the analysis of its composition, revealing that it had 15.5 mol% of CuO, 30 mol% of ZnO, and 54.5 mol% of $Fe_2O_3$. The ratio of X/Y was found to be 0.83.

The magnetic measurement of the carrier revealed that the magnetization value at 3000 Oe was 50 emu/g and the coercive force and the residual magnetism were both zero.

1.5 kg of the powdery carrier was subjected to the forced deterioration test of 100 hours using a ball mill container having a diameter of 15 cm and the number of revolutions of 88 r.p.m. without use of the balls. The carrier was then subjected to the measurement of its specific resistance using a device of FIG. 1. In FIG. 1, indicated at 1 is an upper electrode, at 2 is an insulating hollow cylinder accommodating therein an article being measured, at 3 is a lower electrode, at 4 is a carrier being measured, at 5 is a d.c. power source, at 6 is a voltmeter, and at 7 is a microammeter. The test results are shown in Table 2 as sample a. As will be apparent from Table 2, the carrier of the invention has a very stable resistance.

Figure 2:
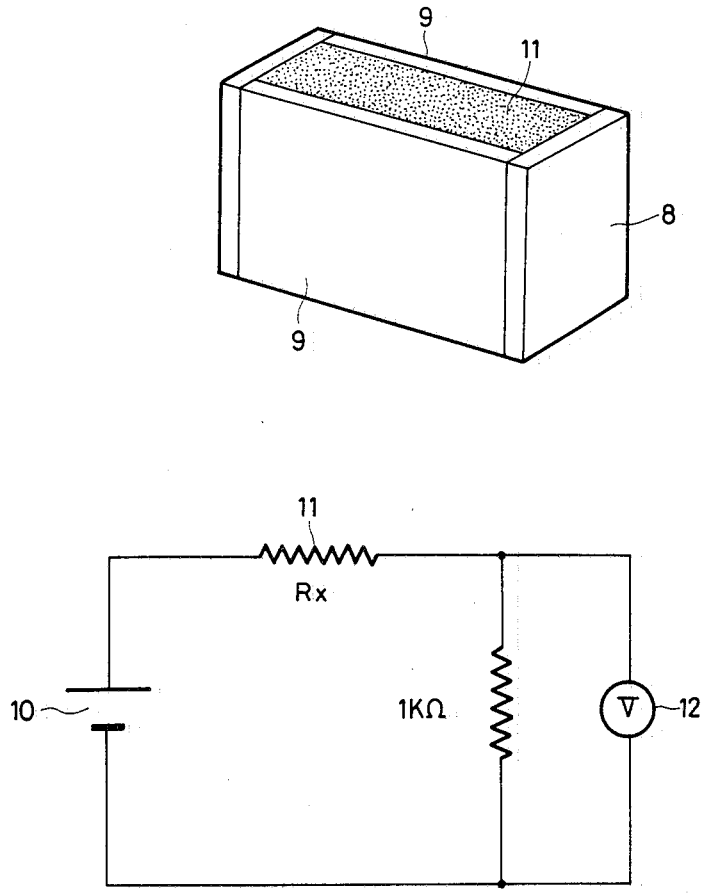
FIG. 2 is a schematic view of a device of measuring dielectric breakdown voltage.
Figure 3:
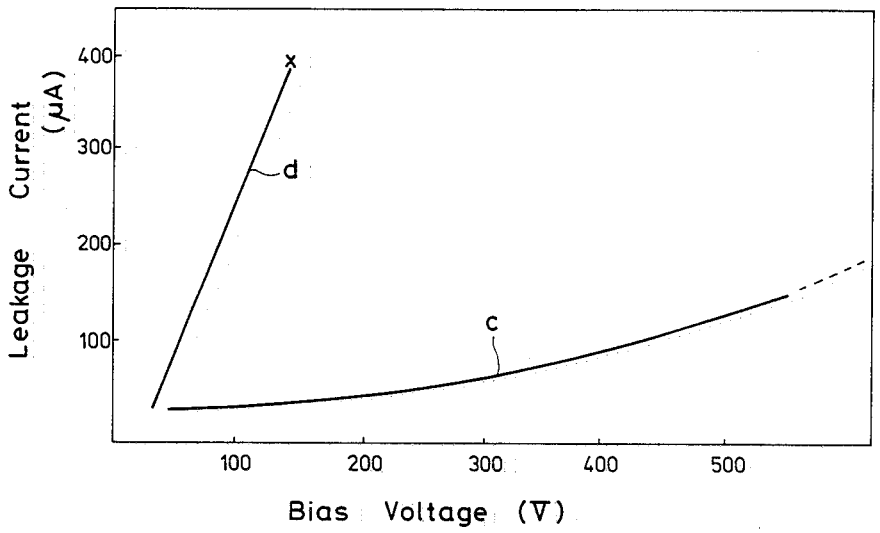
FIG. 3 is a graphical representation of the results of a dielectric breakdown test.

In order to determine a leakage characteristic of bias voltage, the dielectric breakdown voltage was measured using a device shown in FIG. 2. In the figure, indicated at 8 is an insulating container in which an article being measured is accommodated, at 10 is a d.c. power source, at 11 is an article or carrier being measured, and at 12 is a voltmeter. The results are shown in FIG. 3, in which the carrier of the present invention is indicated by curve c. No dielectric breakdown took place even at 500 V.

When the powdery carrier was used for a copying test using a commercially available duplicating machine, clear images were obtained with regard to lines and solid portions.

EXAMPLE 2

21 mol% of CuO, 26 mol% of ZnO, and 53 mol% of $Fe_2O_3$ were treated in the same manner as in Example 1 to obtain a powdery carrier with a size of from 150 to 250 mesh. The carrier had a composition of 21.5 mol% of CuO, 24 mol% of ZnO, and 54.5 mol% of $Fe_2O_3$ and had a X/Y molar ratio of 0.83.

The forced deterioration test was carried out in the same manner as in Example 1 with the result that the resistance varied only in a slight degree as particularly shown as sample a' of Table 2. The magnetization value at 3000 Oe was 52 emu/g with the coercive force and the residual magnetism being both zero. The dielectric breakdown voltage was found to be over 500 V.

The copying test revealed that lines and solid portions were clear.

EXAMPLE 3

15 mol% of CuO, 16 mol% of ZnO, and 69 mol% of $Fe_2O_3$ were treated in the same manner as in Example 1 to obtain a powdery carrier having a size of from 150 to 250 mesh. The carrier had a composition of 15.5 mol% of CuO, 14.5 mol% of ZnO, and 70 mol% of $Fe_2O_3$, and a X/Y molar ratio of 0.43.

The magnetization measurement of the powdery carrier revealed that the magnetization value at 3000 Oe was 42 emu/g and the coercive force and the residual magnetism were both zero. The force deterioration test was effected in the same manner as in Example 1, revealing that the dielectric breakdown voltage was over 500 V. Similar results were obtained as in Example 1 with regard to the forced deterioration test and the copying test.

EXAMPLE 4

17 mol% of CuO, 23 mol% of ZnO, and 60 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1150° C. for 10 hours, and disintegrated into pieces and classified to obtain a 150 to 250 mesh powder.

The carrier had a composition of 17.5 mol% of CuO, 21.5 mol% of ZnO, and 61 mol% of $Fe_2O_3$ and a X/Y molar ratio of 0.64.

The magnetization value at 3000 Oe was found to be 63 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 5

21 mol% of CuO, 21 mol% of ZnO, and 58 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1150° C. for 4 hours, and disintegrated into pieces and classified to obtain a 150 to 250 mesh powder.

The carrier had a composition of 21.5 mol% of CuO, 19 mol% of ZnO, and 59.5 mol% of $Fe_2O_3$ and a X/Y molar ratio of 0.68.

The magnetization value at 3000 Oe was found to be 64 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 6

22 mol% of CuO, 12.5 mol% of ZnO, and 65.5 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1200° C. for 3 hours, and disintegrated into pieces and classified to obtain a 150 to 250 mesh powder.

The carrier had a composition of 22 mol% of CuO, 11.5 mol% of ZnO, and 66.5 mol% of $Fe_2O_3$ and a X/Y molar ratio of 0.50.

The magnetization value at 3000 Oe was found to be 40 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 7

22 mol% of CuO, 11 mol% of ZnO, and 67 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1200° C. for 4 hours, and disintegrated into pieces and classified to obtain a 150 to 250 mesh powder.

The carrier had a composition of 22 mol% of CuO, 10 mol% of ZnO, and 68 mol% of $Fe_2O_3$ and a X/Y molar ratio of 0.47.

The magnetization value at 3000 Oe was found to be 37 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 8

10 mol% of CuO, 11 mol% of ZnO, and 79 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1230° C. for 2 hours, and disintegrated into pieces and classified to obtain a 150 to 250 mesh powder.

The carrier had a composition of 10 mol% of CuO, 10 mol% of ZnO, and 80 mol% of $Fe_2O_3$ and a X/Y molar ratio of 0.25.

The magnetization value at 3000 Oe was found to be 32 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 9

20 mol% of MgO, 25 mol% of ZnO, and 55 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1100° C. for 2 hours, and disintegrated into pieces and classified to obtain a 150 to 250 mesh powder.

The carrier had a composition of 20.5 mol% of MgO, 23.5 mol% of ZnO, and 56 mol% of $Fe_2O_3$ and a X/Y molar ratio of 0.79.

The magnetization value at 3000 Oe was found to be 66 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 10

15 mol% of MgO, 20 mol% of ZnO, and 65 mol% of $Fe_2O_3$ were powdered and mixed in a wet ball mill for 10 hours and after drying, were kept at 900° C. for 4 hours. The resulting mixture was powdered in a wet ball mill for 24 hours to a level of 5 microns. The slurry was granulated and dried, maintained at 1100° C. for 4 hours, and disintegrated into pieces and classified to obtain a 150 to 250 mesh powder.

The carrier had a composition of 15.5 mol% of MgO, 19 mol% of ZnO, and 65.5 mol% of $Fe_2O_3$ and a X/Y molar ratio of 0.53.

The magnetization value at 3000 Oe was found to be 37 emu/g with the coercive force and the residual magnetism being both zero. The forced deterioration test revealed only a little change in resistance. According to the dielectric breakdown test, the dielectric breakdown voltage was found to be over 500 V. The copying test showed good results.

EXAMPLE 11

The powdery carrier of Example 2 was reduced with hydrogen gas at a low temperature of 350° C. for 1 hour. The resistance was $1.5\times10^9$ ohms-cm prior to the reduction and was $7.5\times10^6$ ohms-cm after the reduction. When the carrier was subjected to the magnetization test, it was found that the magnetization value was 68 emu/g with the coercive force and the residual magnetism being both zero. By the copying test, good images were obtained in lines and solid portions. The intensity of the solid portions was more excellent than an intensity prior to the reduction.

EXAMPLE 12

Figure 4:
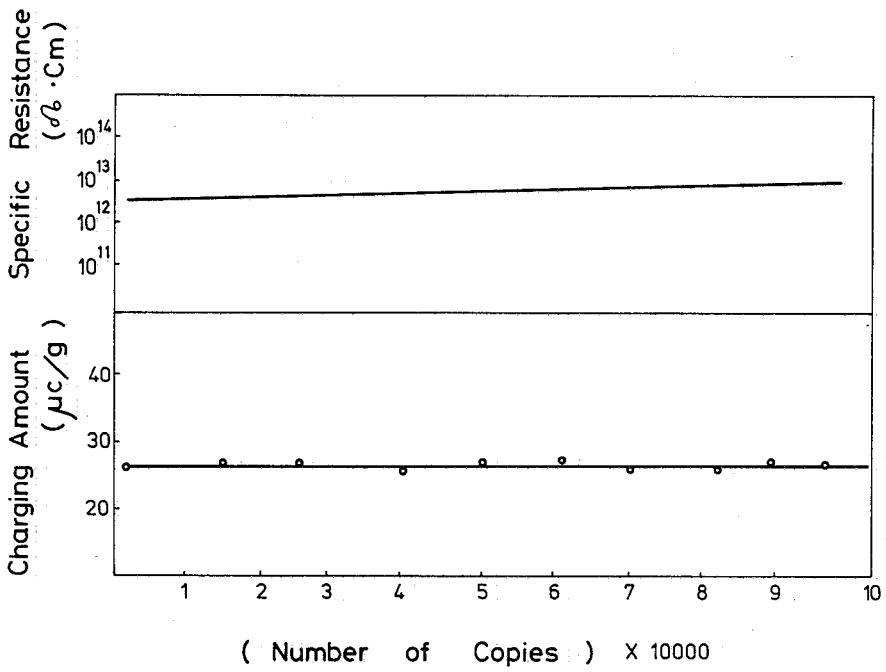
FIG. 4 is a graphical representation of variations in resistance and charging amount of a carrier in a copying test.

The carrier of Example 4 was coated with an acrylic resin as a thin film and was then subjected to the copying test of 100,000 copies using a commercially available duplicating machine. As a result, it was found that the resistance and charging amount were stable (see FIG. 4) with an image density being small in variation and that no fogging phenomenon was observed. A copy-to-copy test showed good results.

COMPARATIVE EXAMPLE 1

An oxidized iron powder with a size of from 150 to 250 mesh provided for comparative purposes was subjected to the measurement of its specific resistance. The results are shown in Table 2 as sample b. The variation in resistance is greater than in the case of the carriers of the present invention.

The dielectric breakdown test revealed that the breakdown voltage was about 150 V (see curve d of FIG. 3.).

COMPARATIVE EXAMPLE 2

25 mol% of CuO, 25 mol% of ZnO, and 50 mol% of $Fe_2O_3$ were treated in the same manner as in Example 1 to obtain a powdery carrier having a size of from 150 to 250 mesh. The analysis of the carrier had a X/Y molar ratio of 0.98.

This carrier was subjected to the copying test using a commercially available duplicating machine with an image which had a conspicuous edge while its solid portion was left out at the center thereof. The specific resistance was measured with a value of $7.1\times10^{10}$ ohms-cm.

The test results of the examples and comparative examples are summarized in Table 1 below.

TABLE 1

| | X/Y | Variation in Resistance by Deterioration | Saturation Magnetization *1 emu/g | Residual Magnetization | Dielectric Breakdown (V) | Copying Solid Portion | Test Line | Variation in Charging Amount | Variation in Resistance |
|---|---|---|---|---|---|---|---|---|---|
| Ex. 1 | 0.83 | small | 50 | 0 | >500 | o | o | — | — |
| Ex. 2 | 0.83 | small | 68 | 0 | >500 | o | o | — | — |
| Ex. 3 | 0.43 | small | 42 | 0 | >500 | o | o | — | — |
| Ex. 4 | 0.64 | small | 63 | 0 | >500 | o | o | — | — |
| Ex. 5 | 0.68 | small | 64 | 0 | >500 | o | o | — | — |
| Ex. 6 | 0.50 | small | 40 | 0 | >500 | o | o | — | — |
| Ex. 7 | 0.47 | small | 37 | 0 | >500 | o | o | — | — |
| Ex. 8 | 0.25 | small | 32 | 0 | >500 | o | o | — | — |
| Ex. 9 | 0.79 | small | 66 | 0 | >500 | o | o | — | — |
| Ex. 10 | 0.53 | small | 37 | 0 | >500 | o | o | — | — |
| Ex. 11 | 0.83 | — | 68 | 0 | >500 | o | o | — | — |
| Ex. 12 | 0.64 | — | — | — | — | o | o | small | small |
| Comp. Ex. 1 | — | large (see Table 2, curve b) | — | 0 | 150 | — | — | — | — |
| Comp. Ex. 2 | 0.98 | — | — | — | — | x | o | — | — |

*1 Values at 3000 Oe.
*2 o: Excellent
o: Good
x: Bad

TABLE 2

| time (hrs) | Sample a (Ω · cm) | a' (Ω · cm) | b (Ω · cm) |
|---|---|---|---|
| 0 | $9.6\times10^9$ | $3.2\times10^9$ | $8.0\times10^8$ |
| 12.5 | $9.7\times10^9$ | $3.2\times10^9$ | $9.7\times10^9$ |
| 25 | $9.7\times10^9$ | $3.5\times10^9$ | $1.0\times10^{12}$ |
| 50 | — | $3.4\times10^9$ | $3.1\times10^{12}$ |
| 75 | $9.8\times10^9$ | $3.7\times10^9$ | $6.0\times10^{12}$ |
| 100 | $1.0\times10^{10}$ | $3.7\times10^9$ | — |

What is claimed is:

1. A carrier for electrophotographic development comprising essentially a disintegrated powder of granules consisting essentially of the compound represented by the formula:

$(CuO)_a(ZnO)_b(Fe_2O_3)_c$ in which $a(mol)+b(mol)+c(mol)=1$ and $0.42 \leqq (a+b)/c \leqq 0.85$.

2. The carrier according to claim 1, wherein $0.05 \leqq a \leqq 0.45$ and $0 \leqq b \leqq 0.40$.

3. The carrier according to claim 1, wherein said formula is $(CuO)_{0.155}(ZnO)_{0.30}(Fe_2O_3)_{0.545}$.

4. The carrier according to claim 1, wherein said formula is $(CuO)_{0.215}(ZnO)_{0.24}(Fe_2O_3)_{0.545}$.

5. The carrier according to claim 1, wherein said formula is $(CuO)_{0.175}(ZnO)_{0.215}(Fe_2O_3)_{0.61}$.

6. The carrier according to claim 1, wherein said formula is $(CuO)_{0.155}(ZnO)_{0.145}(Fe_2O_3)_{0.70}$.

7. The carrier according to claim 1, wherein said formula is $(CuO)_{0.215}(ZnO)_{0.19}(Fe_2O_3)_{0.595}$.

8. The carrier according to claim 1, wherein said formula is $(CuO)_{0.22}(ZnO)_{0.115}(Fe_2O_3)_{0.665}$.

9. The carrier according to claim 1, wherein said formula is $(CuO)_{0.22}(ZnO)_{0.10}(Fe_2O_3)_{0.68}$.

10. The carrier according to claim 1, wherein said formula is $(CuO)_{0.10}(ZnO)_{0.10}(Fe_2O_3)_{0.80}$.

11. A carrier for electrophotographic development consisting essentially of a disintegrated powder of granules having the following composition, said disintegrated powder being reduced on the surface thereof, $(CuO)_a(ZnO)_b(Fe_2O_3)_c$ in which $a(mol)+b(mol)+c(mol)=1$ and $0.42 \leqq (a+b)/c \leqq 0.85$.

12. A carrier for electrophotographic development consisting essentially of a disintegrated powder of granules having the following composition, said disintegrated powder having a resin coating on the surface thereof, $(CuO)_a(ZnO)_b(Fe_2O_3)_c$ in which $a(mol)+b(mol)+c(mol)=1$ and $0.42 \leqq (a+b)/c \leqq 0.85$.

* * * * *

UNITED STATES PATENT AND TRADEMARK OFFICE

CERTIFICATE OF CORRECTION

PATENT NO. : 4,598,034

DATED : July 1, 1986

INVENTOR(S) : Toshio Honjo

It is certified that error appears in the above-identified patent and that said Letters Patent is hereby corrected as shown below:

Col. 3, line 15, change "amounts" to --amount--;

Col. 3, line 52, change "coated" to --coating--;

Claim 4, Col. 9, line 10, change "Claim 1" to --Claim 2--;

Claim 5, Col. 9, line 12, change "Claim 1" to --Claim 2--;

Claim 6, Col. 9, line 14, change "Claim 1" to --Claim 2--;

Claim 7, Col. 9, line 16, change "Claim 1" to --Claim 2--;

Claim 8, Col. 9, line 18, change "Claim 1" to --Claim 2--;

Claim 9, Col. 9, line 20, change "Claim 1" to --Claim 2--;

Claim 10, Col. 10, line 1, change "Claim 1" to --Claim 2--;

Signed and Sealed this

Fourth Day of November, 1986

[SEAL]

*Attest:*

DONALD J. QUIGG

*Attesting Officer*

*Commissioner of Patents and Trademarks*